United States Patent [19]

Inomata et al.

[11] 4,450,766

[45] May 29, 1984

[54] UNIT-TO-UNIT REGISTER ADJUSTING APPARATUS OF MULTICOLOR PRINTING MACHINE

[75] Inventors: Takehiro Inomata, Ibaragi; Nobuya Oyabu, Chiba, both of Japan

[73] Assignee: Komori Printing Machinery Co., Ltd., Tokyo, Japan

[21] Appl. No.: 390,597

[22] Filed: Jun. 21, 1982

[30] Foreign Application Priority Data

Jul. 21, 1981 [JP] Japan ..... 56-114273

[51] Int. Cl.[3] ..... B41F 5/02; B41F 7/06

[52] U.S. Cl. ..... 101/183; 101/211

[58] Field of Search ..... 101/181, 248, 183; 226/2, 3, 15, 16, 17–23, 24, 28, 29–31; 107/136, 137, 138

[56] References Cited

U.S. PATENT DOCUMENTS

| | | | |
|---|---|---|---|
| 2,802,666 | 8/1957 | Crosfield | 101/181 X |
| 3,594,552 | 7/1971 | Adamson | 101/181 X |
| 3,701,464 | 10/1972 | Crum | 101/181 X |

FOREIGN PATENT DOCUMENTS 55-25062 4/1980 Japan .

*Primary Examiner*—J. Reed Fisher

*Attorney, Agent, or Firm*—Gifford, VanOphem & Sprinkle

[57] ABSTRACT

Substantially triangular shaped register marks are applied to respective plate cylinders of a multicolor printing machine. Each register mark is made up of a first side extending laterally of axial direction of a plate cylinder and a second inclined side extending downwardly to an end of the first side. Rotation of register marks is detected by a photoelectric detector and a rotary encoder rotating in synchronism with respective plate cylinders generates a reference pulse and a rotation pulse having a shorter period than the reference pulse. Based on the reference pulse, the rotation pulse and an output of the photoelectric detector, a leading edge time difference signal and a trailing edge time difference signal are formed and then integrated by integrators. In response to outputs of the integrators the peripheral direction and the lateral direction of the respective plate cylinders are adjusted. According to this invention in spite of contamination of register marks they can be detected accurately, and irrespective of peculiar rotation of a printing machine stable and accurate adjustment of the register can be made before commencing printing operation.

13 Claims, 10 Drawing Figures

FIG.9($e_1$)

FIG.9($e_2$)

FIG.9($g_1$)

FIG.9($g_2$)

FIG.9($h_1$)

FIG.9($h_2$)

FIG.9($i_1$)

FIG.9($i_2$)

UNIT-TO-UNIT REGISTER ADJUSTING APPARATUS OF MULTICOLOR PRINTING MACHINE

BACKGROUND OF THE INVENTION

This invention relates to a unit-to-unit register adjusting apparatus of a multicolor printing machine wherein a registration error between various colors is detected before starting printing operations for automatically correcting the registration error.

In a multicolor printing machine, in order to cause imprints on a sheet of paper by printing plates of different colors to perfectly register with each other, a register adjustment is necessary. Heretofore register marks are printed for respective colors and a misalignment of the register marks is observed by an operator, or the states of printed images of respective colors are observed to judge misregister. To have an accurate register, a substantial amount of test printing is necessary, which requires a considerable waster of paper, a long time spent on register adjustment, and a substantially skilled operator.

According to Japanese Patent Publication No. 25062/1980 entitled "Register Adjusting Apparatus", V-shaped register marks are formed on plates of respective colors, and the register marks are detected by photoelectric apparatus for determining the relative positions of the marks when the printing machine is operated, thus adjusting the register before starting the printing operation. With this apparatus, however, due to irregular rotation inherent to a printing machine, electric noise and other external factors, accurate and stable register adjustment can not be obtained.

SUMMARY OF THE INVENTION

Accordingly, it is an object of the present invention to provide an improved unit-to-unit register adjusting apparatus for a multicolor printing machine capable of detecting register errors of respective colors and automatically correcting the register errors before commencing a printing operation.

According to the present invention, there is provided unit-to-unit register adjusting apparatus of a multicolor printing machine including a plurality of plate cylinders. The apparatus includes, substantially triangularly shaped register marks applied to respective plate cylinders, each register mark having a first side extending laterally of axial direction of a plate cylinder and a second inclined side extending downwardly to an end of the first side. A register mark detector is provided including a projector for projecting light on the register mark and a light receiver for receiving light reflected by the register marks. A rotary encoder rotates in synchronism with respective plate cylinders for generating a reference pulse and a rotation pulse having a period shorter than that of the reference pulse. An input unit is provided including gain control means for controlling an output of the register mark detector to have a definite peak value. Means are provided for differentiating an output of the gain control means for producing a leading edge pulse signal and a trailing edge pulse signal corresponding to leading and trailing edges of the output of the gain control means. Time difference detecting means respond to time differences between the leading edge pulse signal and the rotation pulse and between the trailing edge pulse signal and the rotation pulse for generating a leading edge time difference signal and a trailing edge time difference signal. Integrating means are provided for the time difference detecting means for independently integrating the leading edge time difference signal and the trailing edge time difference signal. Finally, the apparatus includes means responsive to an output of the integrating means corresponding to the leading edge time difference signal for adjusting phases of rspective plate cylinders in the peripheral direction, and means responsive to an output of the integrating means corresponding to the trailing edge time difference signal for adjusting lateral positions of respective plate cylinders.

BRIEF DESCRIPTION OF THE DRAWING

In the accompanying drawings:

FIGS. 9*a* to 9*i* are timing charts showing waveforms of various circuit elements shown in FIGS. 4, 5 and 6.

DESCRIPTION OF THE PREFERRED EMBODIMENT

Figure 1:
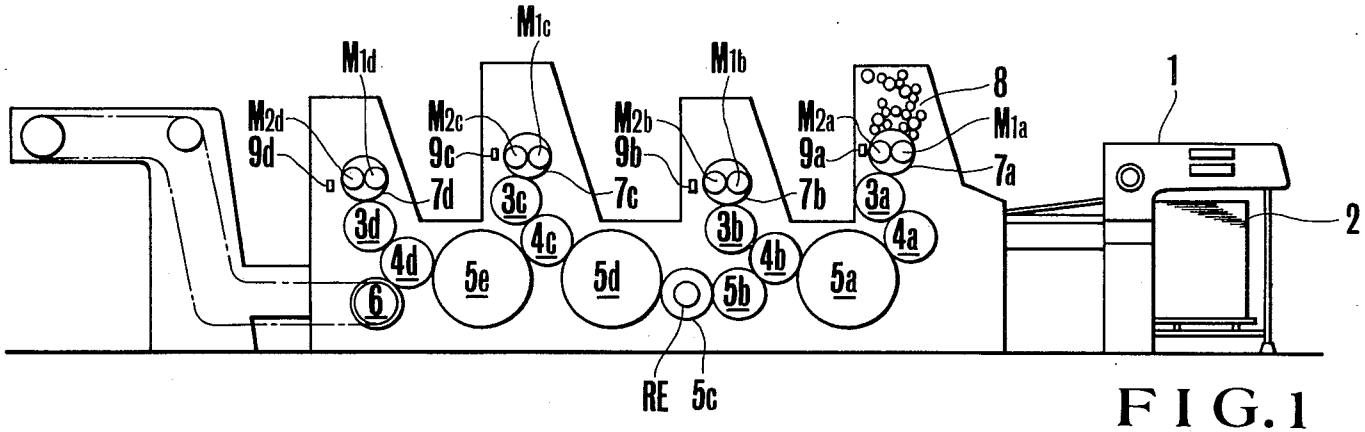
FIG. 1 is a side view diagrammatically showing a multicolor printing machine.

In the multicolor printing machine shown in FIG. 1, a sheet of paper 2 supplied from paper feeding device 1 is first inserted into a nip between a blanket cylinder 3*a* and an impression cylinder 4*a* among a plurality of blanket cylinders 3*a* to 3*d* and impression cylinders 4*a* to 4*d* provided for respective colors, then successively passed through the nips between blanket cylinders 3*b* to 3*d* and impression cylinders 4*b* to 4*d* via transfer cylinders 5*a* to 5*c*, and finally discharged from a discharge roller 6. Plate cylinders 7*a* to 7*d* respectively mounted with printing plates for respective colors are urged against respective blanket cylinders 3*a* to 3*d*. Printing inks supplied to the printing plates of respective plate cylinders 7*a* to 7*d* through inking roller groups 8 are transferred to blanket cylinders 3*a* to 3*d* and then printed onto the printing paper for effecting multicolor printing.

Respective plate cylinders 7*a* to 7*d* are provided with electric motors $M_{1a}$ to $M_{1d}$ for adjusting their phases in the peripheral or circumferential directions and electric motors $M_{2a}$ to $M_{2d}$ for adjusting their positions in the lateral or axial directions. Such circumferential and axial position adjusting mechanisms are disclosed in U.S. Pat. Nos. 2,775,935 and 4,006,685. As will be described later in more detail, light projector and reflected light receivers 9*a* to 9*d* are disposed to face respective plate cylinders 7*a* to 7*d* and a rotary encoder RE is directly coupled to a transfer cylinder 5*c* rotating in synchronism with respective plate cylinders 7*a* to 7*d*. The rotary encoder RE is of the well known type. For example, it comprises a rotary disc provided with coded perforations and a light projector and a light receiver disposed on the opposite sides of the rotary disc, or a rotary disc magnetically recorded with codes which are read with a magnetic head. Alternatively, the encoder may comprise a combination of a well known pulse generator and a decoder.

Figure 2:
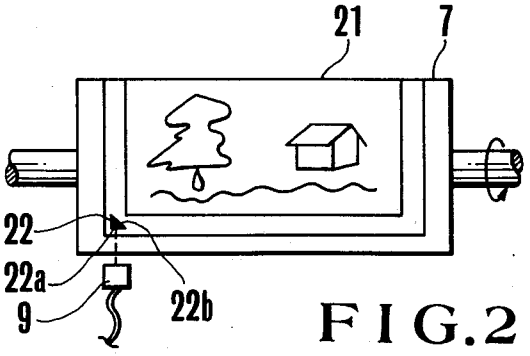
FIG. 2 is a diagrammatic side view showing the relation between a plate cylinder, a light projector and a light receiver.

FIG. 2 shows the relationship between a plate cylinder 7, and a light projector and receiver 9. As shown, a triangularly shaped register mark 22 is formed at a peripheral margin of a printing plate 21 mounted on the plate cylinder 7. The register mark 22 has a horizontal bottom side 22*a* and an inclined side 22*b*. The light projector and receiver 9 is mounted on a stationary member, the frame of the printing machine, for example, to face the register mark 22.

Figure 3:
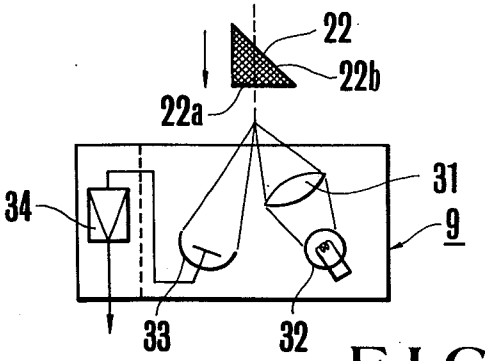
FIG. 3 shows the detail of a register mark, the light projector and the light receiver.

FIG. 3 shows the detail of the register mark 22 and the light projector and receiver 9. Thus, a light beam from a light source 32 is projected through a lens 31 upon a substantially central portion of the register mark 22 which rotates in the direction of an arrow 22*c* together with the plate cylinder 7. The quantity of reflected light which varies as the register mark 22 rotates, is measured and converted into an electric signal by a light receiving element 33 in the form of a photoelectric tube. After being amplified by an amplifier 34, the electric signal is outputted as a detector output.

Figure 4:
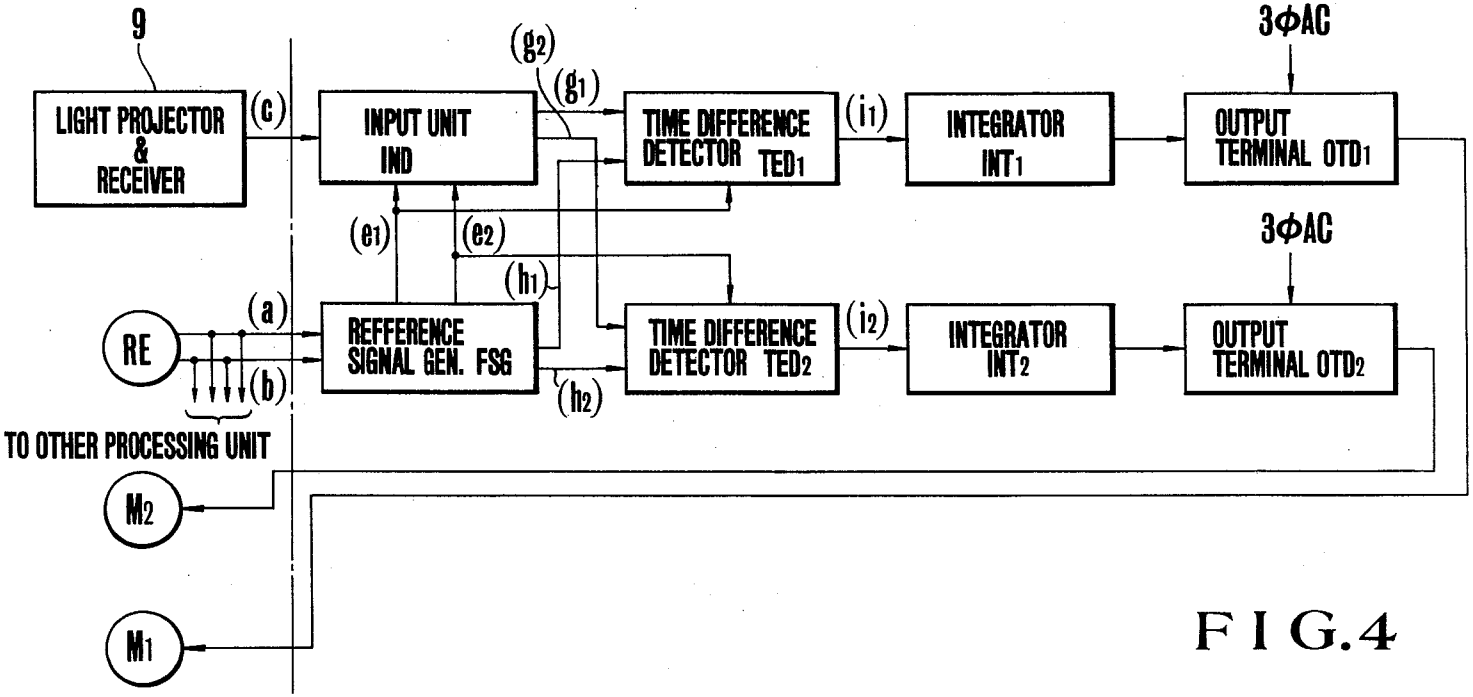
FIG. 4 is a block diagram showing the entire construction of the register adjusting apparatus embodying the invention.
Figure 5:
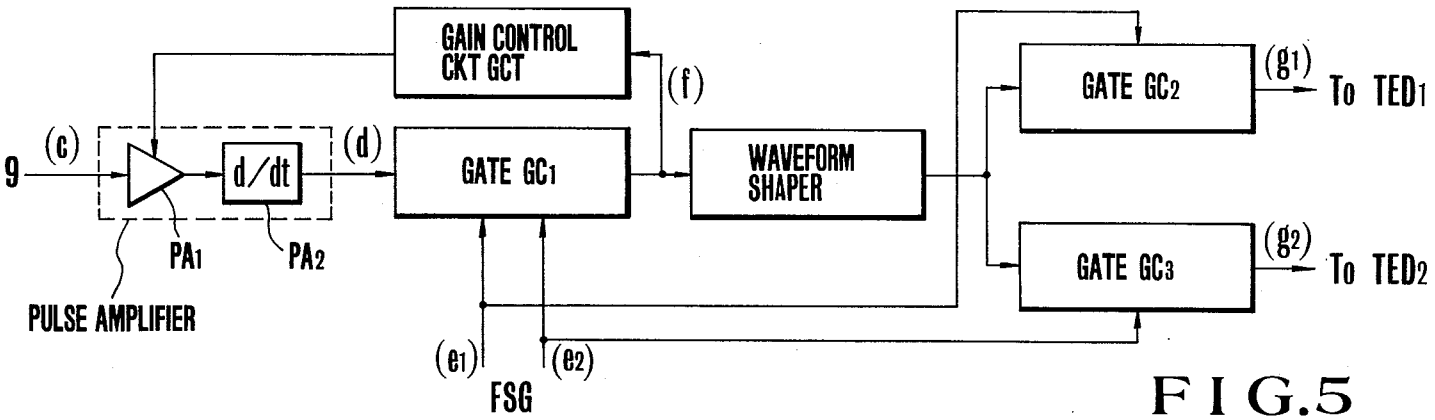
FIG. 5 is a block diagram showing the input unit of the register adjusting apparatus.
Figure 6:
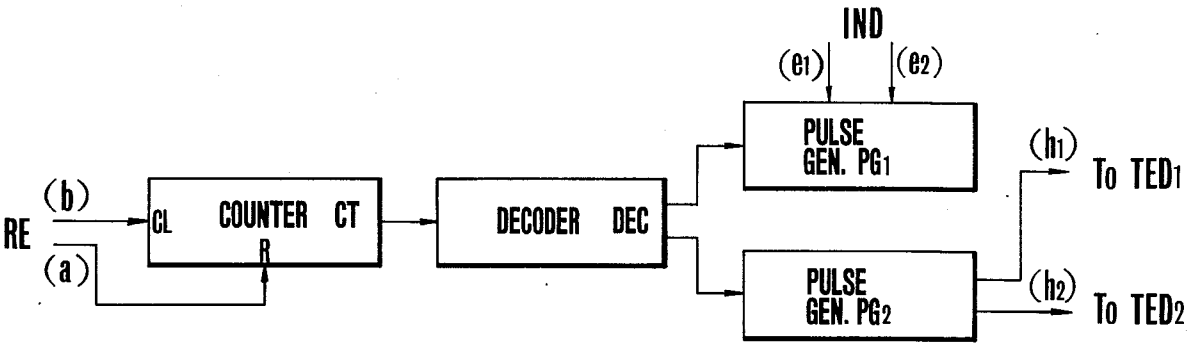
FIG. 6 is a block diagram showing a reference signal generator thereof.
Figure 7:
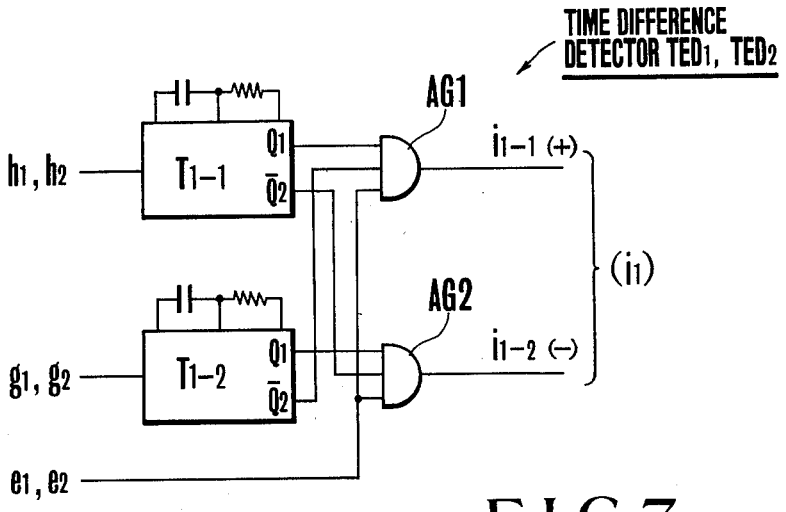
FIG. 7 is a connection diagram showing the time difference detectors.
Figure 8:
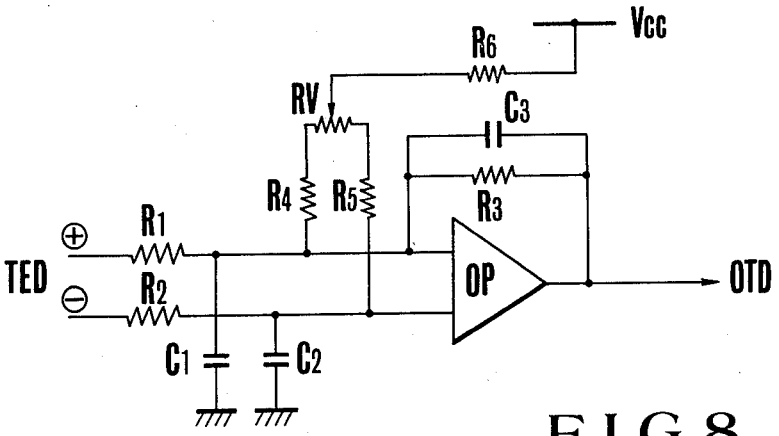
FIG. 8 is a connection diagram showing one of the integrators thereof.

FIG. 4 is a block diagram showing the entire electric circuit. As shown in FIG. 1, a single rotary encoder RE is provided in common for all of the plate cylinders while other elements are provided for respective color printing cylinders 7*a* to 7*d*. The detail of an input unit IND shown in FIG. 4 is shown in FIG. 5, while that of a reference signal generator FSG is shown in FIGS. 6 and 7. The detail of an integrators $INT_1$ and $INT_2$ are shown in FIG. 8.

Figures 9A, 9B, 9C, 9D, 9F:
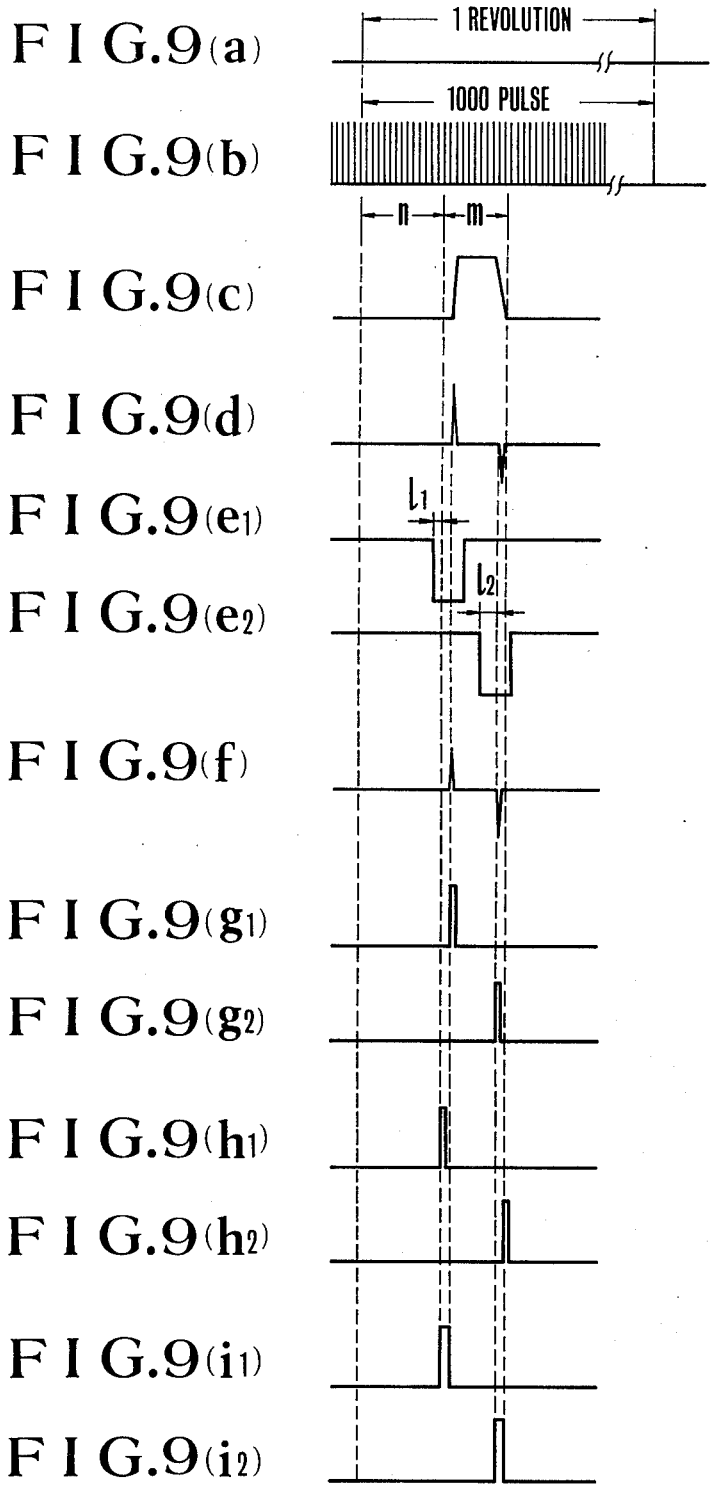
Figures 10A, 10B, 10C, 10D, 10E, 10F, 10G, 10H, 10I:
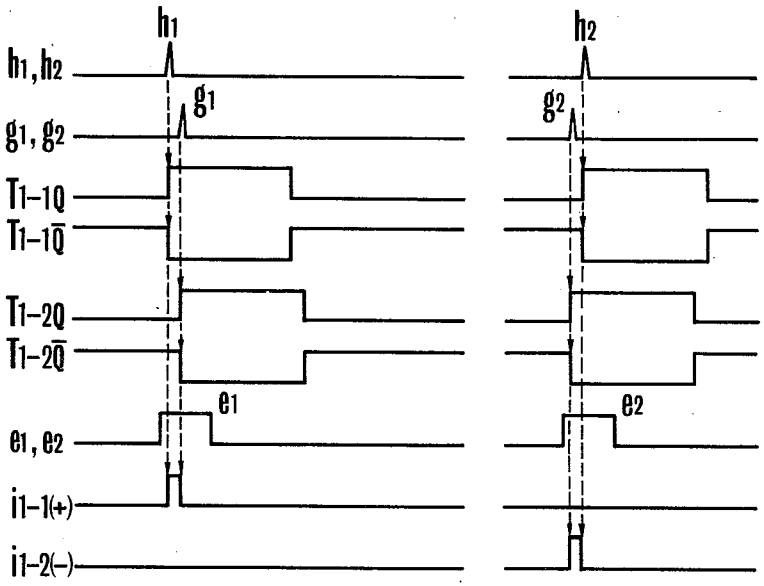
FIGS. 10*a* to 10*i* show waveforms of signals generated by a reference signal generator, Schmitt trigger circuits and ADD gate circuits shown in FIG. 7.

The waveforms at various portions shown in FIGS. 4, 5 and 6 are shown by the timing charts shown in FIGS. 9 and 10. The rotary encoder RE produces a reference pulse $a_1$ shown in FIG. 9*a*, once per revolution, and a rotation pulse $b_1$ shown in FIG. 9*b*, synchronous with the reference pulse but having a shorter period. In this example the rotation pulse is generated 1,000 times per revolution.

The detected output $c_1$ shown in FIG. 9*c*, produced by the light projecting and receiving sensor 9 is sent to the input unit IND and amplified by a pulse amplifier PA incuding a variable gain amplifier $PA_1$ and a differentiating circuit $PA_2$ which differentiates the leading and trailing edges of the detected output to produce a differentiated pulse $d_1$ shown in FIG. 9*d*. The reference signal is derived out through a gate circuit $GC_1$, enabled by gate pulses $e_1$ and $e_2$, shown in FIGS. 9*e*$_1$ and 9*e*$_2$, to form an extracted pulse $f_1$ shown in FIG. 9*f*. The waveform of the extracted pulse is shaped and detected by a waveform shaper WF. The extracted pulse shaped waveform f is separated into a leading edge pulse $g_1$, shown in FIG. 9*g*$_1$, and a trailing edge pulse $g_2$, shown in FIG. 9*g*$_2$, by gate circuits $GC_2$ and $GC_3$ respectively, enabled by pulses shown in FIGS. 9*e*$_1$ and 9*e*$_2$.

The crest or peak value of the extracted pulse f shown in FIG. 9*f* is applied to the pulse amplifier PA via a gain control circuit GCT to control the gain of the pulse amplifier PA such that the extracted pulse shown in FIG. 9*f* will have a definite crest or peak value. Accordingly, the detected output shown in FIG. 9*c* is differentiated only when its crest value becomes constant. Consequently, the differentiated pulse shown in FIG. 9*d* can be produced from the sharply rising leading and relatively slowly falling trailing edges of the detected output shown in FIG. 9*c* at accurate timings, with the result that the differentiated pulses shown in FIG. 9*d* having nonuniform crest values are converted into the extracted pulses shown in FIG. 9*f* having the same crest or peak values as a result of the automatic gain control.

As shown in FIG. 6, the reference signal generator FSG includes a counter CT which is reset by the reference pulse a (shown in FIG. 9*a*) from the rotary encoder RE and counts the number of rotation pulses b shown in FIG. 9*b*. The output of the counter CT is decoded by a decoder DEC to drive pulse generators $PG_1$ and $PG_2$ in the form of multivibrators or the like for producing gate pulses $C_1$ and $C_2$ shown in FIGS. 9*e*$_1$ and 9*e*$_2$, and reference timing pulses shown in FIGS. 9*h*$_1$ and 9*h*$_2$ based on the reference pulse a shown in FIG. 9*a*. In this example, reference timing pulses $h_1$ and $h_2$, shown in FIGS. 9*h*$_1$ and 9*h*$_2$, are generated in accordance with nth and (n+m)th rotation pulses b starting from the reference pulse a. Furthermore, gate pulses $e_1$ and $e_2$, are generated in accordance with the (n−11)th and (n+m−12)th rotation pulses b.

Due to the actions of the gate pulses $e_1$ and $e_2$, pulses of only the necessary timings are extracted and the leading edge pulse $g_1$ and the trailing edge pulse $g_2$ with noise components removed are separately applied to time error difference detectors $TED_1$ and $TED_2$ and converted into a leading edge time difference signal $i_1$ and a trailing edge time difference signal $i_2$, shown in FIGS. 9*i*$_1$ and 9*i*$_2$, and having pulse widths corresponding to the time differences between the reference timing pulses $h_1$ and $h_2$ from the reference signal generator FSG. These time difference signals are applied to integrators $INT_1$ and $INT_2$ shown in FIG. 8.

Each of the time difference detectors $TED_1$ and $TED_2$ is constituted by a flip-flop circuit and a logic gate circuit. The time difference detectors $TED_1$, $TED_2$ produce the leading edge signals $i_1$ and trailing edge time difference signal $i_2$ and have positive or negative polarities determined by the time relation of the leading edge pulse $g_1$ and trailing edge pulse $g_2$ relative to the reference timing pulses $h_1$ and $h_2$. The detail of the time difference detectors $TED_1$ and $TED_2$ will be described with reference to FIG. 7. These detectors include two Schmitt trigger circuits $T_{1-1}$ and $T_{1-2}$, and two AND gate circuits AG1 and AG2. When the input IND and the reference signal generator FSG send out outputs $g_1$ and $g_2$ shown in FIG. 10*a* and outputs $h_1$ and $h_2$ shown in FIG. 10*b*, the Schmitt trigger circuit $T_{1-1}$ changes its state when the outputs $h_1$ and $h_2$ exceed a predetermined threshold level to produce output signals shown in FIGS. 10*c* and 10*d* at its output terminals $Q_1$ and $Q_1$. In the same manner, the Schmitt trigger circuit $T_{1-2}$ changes its state when the outputs g1 and g2 exceed a predetermined threshold level for producing output signals shown in FIGS. 10*c* and 10*f* at its output terminals $Q_2$ and $Q_2$. Consequently, the AND gate circuit AG1 produces a positive output $i_{1-1}$, shown in FIG. 10*h*, when the $Q_1$ output of the Schmitt trigger circuit $T_{1-1}$ and the $Q_2$ output of the Schmitt trigger circuit $T_{1-2}$ are at a high level and the output $e_1$, shown by FIG. 10*g*, of the reference signal generator FSG is also at a high level. In the same manner, the AND gate circuit AG2 produces a negative output shown in FIG. 10*i* when the Q output of the Schmitt trigger circuit $T_{1-1}$ and the $Q_2$ output of the Schmitt trigger circuit $T_{1-2}$ are at a high level and the output e2 (shown in FIG. 10*i*) of the reference signal generator FSG is also at a high level. The waveforms shown in FIGS. 10*h* and 10*i* correspond to those shown in FIGS. 9*i*$_1$ and 9*i*$_2$.

The time difference signals (shown in FIGS. 9*i*$_1$ and 9*i*$_2$) repeatedly produced in accordance with the rotation of the printing plate 7 are respectively applied to differential integrators $INT_1$ and $INT_2$ shown in FIG. 8 and then supplied to capacitors $C_1$ and $C_2$ through resistors $R_1$ and $R_2$, depending upon their polarities, to be integrated. The time difference signals are also smoothed by an integrator made up of an operational amplifier OP, a capacitor $C_3$, and a resistor $R_3$ and and outputted as an output signal corresponding to the leading and trailing edge time difference signal shown in FIGS. 9*i*$_1$ and 9*i*$_2$.

Across two input terminals of the operational amplifier OP is applied a bias voltage from a source $V_{cc}$ through registers $R_4$, $R_5$ and $R_6$ and a potentiometer resistor RV, so that it is possible to make zero the output by the adjustment of the potentiometer resistor RV and to finely adjust the relation among the leading and trailing edges of the output c and the time difference signals $i_1$ and $i_2$.

The outputs $k_1$ and $k_2$ of the integrators $INT_1$ and $INT_2$ are interrupted in accordance with a three phase AC input voltage and have polarities depending upon the polarity of the input. The outputs $k_1$ and $k_2$ are applied to motors $M_1$ and $M_2$ through output terminals $OTD_1$ and $OTD_2$ respectively. Consequently, the motors $M_1$ and $M_2$ rotate according to the voltages and polarities at the output terminals $OTD_1$ and $OTD_2$ for performing phase adjustment in the peripheral direction and the position adjustment in the lateral direction of the printing plate 7.

As can be noted from FIGS. 2, 3 and 9, the leading edge of the detected output (shown in FIG. 9*c*) varies with time according to the rotational phase of the plate 7. As a consequence, the time of generating the leading edge signal 9$_1$ varies so that the pulse width of the leading edge time difference signal $i_1$ varies followed by the variation in the output voltage of the integrator $INT_1$. Thus, the motor $M_1$ is controlled in a direction of decreasing such variation to automatically effect the register adjustment in the circumferential direction. The control is stopped when the leading edge time difference signal shown in FIG. 9*i* is not generated.

The register adjustment in the lateral direction is made similarly according to the leading edge of the detected output shown in FIG. 9*a* and the control is terminated when the trailing edge time difference signal shown in FIG. 9*c* is not generated.

As above described, by adjusting the potentiometer register RV shown in FIG. 8, an optimum state can be set manually.

The output terminals $OTD_1$ and $OTD_2$ may be constituted by comparators, pulse generators thyristors or relays.

The configuration of the register mark 22 may be of any desired shape so long as it comprises a bottom side 22*a* and an inclined side 22*b*. Further, various circuit elements can be suitably modified so long as they can perform as desired.

As above described, according to this invention, since the input unit has an automatic gain performance, pulse signals accurately corresponding the leading and trailing edges of the detected output can be obtained irrespective of the contamination of the register mark. Moreover since an integrator is connected between the detector and the input unit, a register adjustment can be made stably at a high accuracy before commencing the printing operation irrespective of a peculiar rotation characteristic of a printing machine so that the invention is applicable to color printing machines of various types.

What is claimed is:

1. A unit-to-unit register adjusting apparatus of a multicolor printing machine including a plurality of plate cylinders, said apparatus comprising:

a single substantially triangularly shaped register mark applied to respective plate cylinders, each register mark having a first side extending laterally of axial direction of a plate cylinder and a second inclined side extending downwardly to an end of said first side;

a register mark detector including a projector for projecting light on said register mark and a light receiver for receiving light reflected by said register mark such that said register mark detector generates an output signal including an output pulse corresponding to the alignment of said register mark detector with said register mark as said plate cylinder rotates;

a rotary encoder rotating in synchronism with respective plate cylinders for generating a reference signal having a reference pulse and a rotation signal having a rotation pulse, said rotation pulse having a period shorter than that of said reference pulse;

an input unit comprising gain control means for controlling said output pulse of said register mark detector to have a predetermined peak value, and signal processing means for differentiating an output of said gain control means for producing a differentiated signal having a leading edge pulse and a trailing edge pulse corresponding to leading and trailing edges of the output of said gain control means, respectively;

time difference detecting means responsive to time differences between said leading edge pulse and said rotation pulse and between said trailing edge pulse and said rotation pulse for generating a leading edge time difference signal and a trailing edge time difference signal;

integrating means provided for said time difference detecting means for independently integrating said leading edge time difference signal to generate a leading edge integrated signal and said trailing edge time difference signal to generate edge integrated signal;

first adjusting means responsive to said leading edge integrated signal for adjusting the relative phase angles of respective plate cylinders in the peripheral direction; and second adjusting means responsive to said trailing edge integrated signal for adjusting lateral positions of respective plate cylinders.

2. The unit-to-unit register adjusting apparatus of claim 1 wherein there are one thousand of said rotation pulses for each of said reference pulses.

3. The unit-to-unit register adjusting apparatus of claim 1 wherein said register mark detector comprises:

a lens;

a light projector means projecting a direct beam of light through said lens at said plate cylinder such that said plate cylinder rotates, said direct beam of light periodically encountering said register mark, said direct beam of light further reflecting from said plate cylinder in the form of a reflected beam of light; and photoelectric means receiving said reflected beam of light and generating said output signal in response to the intensity of said reflected beam of light and said output pulse in response to said reflected beam of light reflecting off of said register mark.

4. The unit-to-unit register adjusting apparatus of claim 1 wherein a signal rotary encoder is provided for each of said plate cylinders and further comprising a plurality of said register mark detectors, gain control means, time difference detecting means, integrating means, signal processing means, first adjusting means, and second adjusting means, each corresponding to one of said plate cylinders.

5. The unit-to-unit register adjusting apparatus of claim 1 wherein said input unit further comprises:

a variable gain amplifier responsive to said output signal of said register mark detector and amplifying said output signal to produce an amplified output signal;

a differentiating circuit responsive to said amplified output signal from said variable gain amplifier and differentiating said amplified output signal to produce said differentiated signal;

a first gate circuit responsive to said differentiated signal and said rotation signal to form an extracted signal having an extracted pulse; and a gain control circuit responsive to said extracted signal to apply the peak value of said extracted pulse to said variable gain amplifier to control the gain of said variable gain amplifier and limit the peak value of said output pulse to a predetermined level, such that said output signal is differentiated only when its peak value becomes constant to produce an accurate differentiated signal.

6. The unit-to-unit register adjusting apparatus of claim 5 wherein said input unit further comprises:

a waveform shaper responsive to said extracted signal to generate a leading edge signal having a leading edge pulse corresponding to said leading edge pulse of said differentiated signal and further to generate a trailing edge signal having a trailing edge pulse corresponding to said leading edge pulse of said differentiated signal.

7. The unit-to-unit register adjusting apparatus of claim 1 wherein said input unit further comprises means responsive to said differentiated signal for generating a leading edge signal having a leading edge pulse corresponding to said leading edge pulse of said differentiated signal and further for generating a trailing edge signal having a trailing edge pulse corresponding to said trailing edge pulse of said differentiated signal.

8. The unit-to-unit register adjusting apparatus of claim 7 wherein said time difference detecting means comprises:

first time difference detecting means responsive to said leading edge signal and said rotation signal for generating said leading edge time difference signal; and second time difference detecting means responsive to said trailing edge signal and said rotation signal for generating said trailing edge time difference signal.

9. The unit-to-unit register adjusting apparatus of claim 1 wherein said time difference detecting means comprises two Schmitt triggers and two AND gates.

10. The unit-to-unit register adjusting apparatus of claim 1 further comprising a reference signal generator interposed said input unit and said time difference detecting means, said reference signal generator comprising:

a counter responsive to said rotation signal and said reference signal for counting said rotation pulses; and a pulse generator responsive to the output of said counter to produce gate signals having gate pulses and reference timing signals having reference timing pulses, each generated after predetermined numbers of rotation signals have been counted.

11. The unit-to-unit register adjusting apparatus of claim 1 wherein said integrating means further comprises:

an operational amplifier having two inputs and two outputs, one of said inputs being responsive to said leading edge pulse and the other of said inputs being responsive to said trailing edge pulse;

a resistor interconnected in series between said output and one of said inputs;

a first capacitor interconnected in parallel with said resistor; and variable bias voltage means between said inputs, said variable bias voltage means permitting fine adjustment therebetween.

12. A method for providing unit-to-unit adjusting of a plate cylinder for a multicolor printing machine including a plurality of plate cylinders, said method comprising the steps of:

disposing a single substantially triangularly shaped register mark on each of said plate cylinder, said register mark having a first side extending laterally of an axial direction of said plate cylinder and a second inclined side extending downwardly to an end of said first side;

projecting a beam of light on said plate cylinder such that said beam of light periodically encounters said register mark and further such that said beam of light is reflected therefrom in a reflected beam of light;

receiving said reflected beam of light and generating in response thereto an output signal including an output pulse corresponding to the detection of said register mark;

generating a reference signal having a reference pulse and a rotation signal having a rotation pulse, said rotation pulse having a period shorter than that of said reference pulse;

limiting said output pulse to a predetermined peak value;

generating a differentiated signal in response to said output signal, said differentiated signal having a leading edge pulse and a trailing edge pulse corresponding to the leading and trailing edges of said output pulse and, accordingly, corresponding to the detection of said first and said second sides of said triangularly shaped register mark;

generating a leading edge differentiated signal in response to the time difference between said leading edge pulse of said differentiated signal and said rotation pulse of said rotation signal;

generating a trailing edge differential signal in response to the time difference between said trailing edge pulse of said trailing edge signal and said rotating pulse of said rotating signal;

generating a leading edge integrated signal corresponding to the integration of said leading edge differentiated signal;

generating a trailing edge integrated signal corresponding to the integration of said trailing edge differentiated signal;

adjusting the relative phase angles of the said plate cylinder in the peripheral direction thereof in response to said leading edge integrated signal; and adjusting the lateral position of said plate cylinders in response to said trailing edge integrated signal.

13. The method of claim 12 further comprising the step of amplifying said output signal prior to said limiting step.

* * * * *